US008677574B1

(12) United States Patent
Thiessen et al.

(10) Patent No.: US 8,677,574 B1
(45) Date of Patent: Mar. 25, 2014

(54) ZIPPER PULL EXTENDER

(76) Inventors: Ken Thiessen, Cleburne, TX (US); Judy Thiessen, Cleburne, TX (US)

( * ) Notice: Subject to any disclaimer, the term of this patent is extended or adjusted under 35 U.S.C. 154(b) by 135 days.

(21) Appl. No.: 13/186,887

(22) Filed: Jul. 20, 2011

(51) Int. Cl.
*A44B 19/24* (2006.01)

(52) U.S. Cl.
USPC ..... 24/429; 24/704.1

(58) Field of Classification Search
USPC ..... 24/429, 704.1; 294/3.6
See application file for complete search history.

(56) References Cited

U.S. PATENT DOCUMENTS

| | | | | |
|---|---|---|---|---|
| 3,249,977 | A * | 5/1966 | Cloud, Sr. | 294/3.6 |
| 4,193,172 | A | 3/1980 | Kanzaka | |
| 4,368,562 | A | 1/1983 | Minami | |
| 4,389,758 | A | 6/1983 | Akashi | |
| 4,873,750 | A | 10/1989 | Tracy | |
| 5,603,542 | A * | 2/1997 | Walker | 294/3.6 |
| 5,690,444 | A * | 11/1997 | Yuuki et al. | 403/268 |
| 6,237,199 | B1 * | 5/2001 | Chou Wang | 24/429 |
| 6,804,867 | B2 * | 10/2004 | Oda et al. | 24/429 |
| 7,574,783 | B2 * | 8/2009 | Muratsubaki et al. | 24/429 |
| 2005/0050698 | A1 * | 3/2005 | Muratsubaki et al. | 24/429 |
| 2005/0198789 | A1 * | 9/2005 | Wang | 24/429 |
| 2006/0242804 | A1 | 11/2006 | Griffiths | |
| 2007/0124901 | A1 * | 6/2007 | Cyr et al. | 24/429 |

* cited by examiner

*Primary Examiner* — Robert J Sandy
*Assistant Examiner* — David Upchurch
(74) *Attorney, Agent, or Firm* — Montgomery Patent & Design; Robert C. Montgomery

(57) ABSTRACT

A zipper pull extender to assist a user in gripping and operating zippers on clothing includes a durable sleeve body which slides over an existing zipper pull tab. A hollow interior portion of the body includes a spring with a hooked end which engages a zipper pull aperture when slid over the zipper pull tab. The sleeve also includes a small detachment aperture for receiving a removal tool. When inserted into the tool aperture, the tool presses against the spring to disengage the hooked end from the zipper pull aperture for removal of the zipper.

10 Claims, 3 Drawing Sheets

ZIPPER PULL EXTENDER

RELATED APPLICATIONS

The present invention was first described in a notarized Official Record of Invention on Jul. 16, 2010, that is on file at the offices of Montgomery Patent and Design, LLC, the entire disclosures of which are incorporated herein by reference.

FIELD OF THE INVENTION

The present invention relates generally to zipper fasteners, and in particular, to a removable zipper pull extender attachable to a pull tab of a zipper fastener.

BACKGROUND OF THE INVENTION

Zipper fasteners are used on a wide variety of clothing, outerwear, bags, luggage, and sporting and camping gear. Typically the zipper fastener is formed of two (2) strips of zipper tape, each being affixed to one (1) of two (2) opposing pieces of an article which is to be joined. Each zipper tape has a plurality of specially shaped teeth which mate together to retain the opposing strips of zipper tape together. A hand-operated slider moves along the rows of teeth and meshes together and separates the opposing rows of teeth, depending on the direction of the slider's movement. Attached to the slider is the zipper pull tab which must be gripped by the user.

Unfortunately, the use of a zipper can be nearly impossible for some simply because the zipper pull is too small to securely grasp. People with physical disabilities, such as the elderly, the handicapped, or those recovering from injuries or surgery know all too well of some of the difficulties that they encounter while performing tasks that most of us take for granted. What comes easily to those that are not physically challenged, such as climbing stairs or bending down to tie one's shoes, requires extreme physical exertion for the disabled or, worse yet, is altogether impossible to accomplish without assistance. Among these difficulties, getting dressed is perhaps the most common, even including the simple movement required to pull up or pull down a zipper. Not only is this something that others must help them with, it is also an embarrassing moment for many.

Various decorative attachments, lanyard cords, and tab attachments exist intended to increase the size or alter the appearance of the pull tab of the zipper pull slider. Unfortunately existing attempts suffer from one or more disadvantage or deficiency related to design or utilization. These attempts are typically limited to particular types and styles of pull tabs and it can be difficult for a user to either securely retain the attachment to the pull tab or remove the attachment from the pull tab when desired.

SUMMARY OF THE INVENTION

The inventor has therefore recognized the aforementioned inherent problems and lack in the art and observed that there is a need for a means by which the elderly, physically disabled, or injured can be provided with an aid to assist in operating zippers without assistance from others. In accordance with the invention, it is an object of the present embodiments to solve at least one (1) of these problems.

The inventor recognized these problems and has addressed this need by developing a zipper pull extender that provides for greater independence and self sufficiency for those who suffer from reduced physical dexterity. The inventor has thus realized the advantages and benefits of providing the zipper pull extender having a generally rectangular body with a hollow interior and an engaging aperture disposed on one end for insertable access to the hollow interior by the pull tab of a zipper fastener. A retaining spring is provided having an end affixed to the body within the hollow interior to releasably engage the pull tab upon insertion into the hollow interior. Additionally, a tool aperture is disposed through a rear surface of the body for providing access to the hollow interior and thus the spring by a removal tool. The removal tool is insertable though the tool aperture to deflect the spring away from the pull tab to disengage and release the pull tab from within the hollow interior. The spring includes a hooked end opposite the end affixed to the body. The hooked end insertably engages a zipper aperture disposed through the pull tab to retain the pull tab within the hollow interior. The removal tool includes a generally cylindrical pin suitably sized for insertion through the tool aperture to contact and deflect the spring and a handle affixed to an end of the pin to be gripped by the user.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

Figure 1:
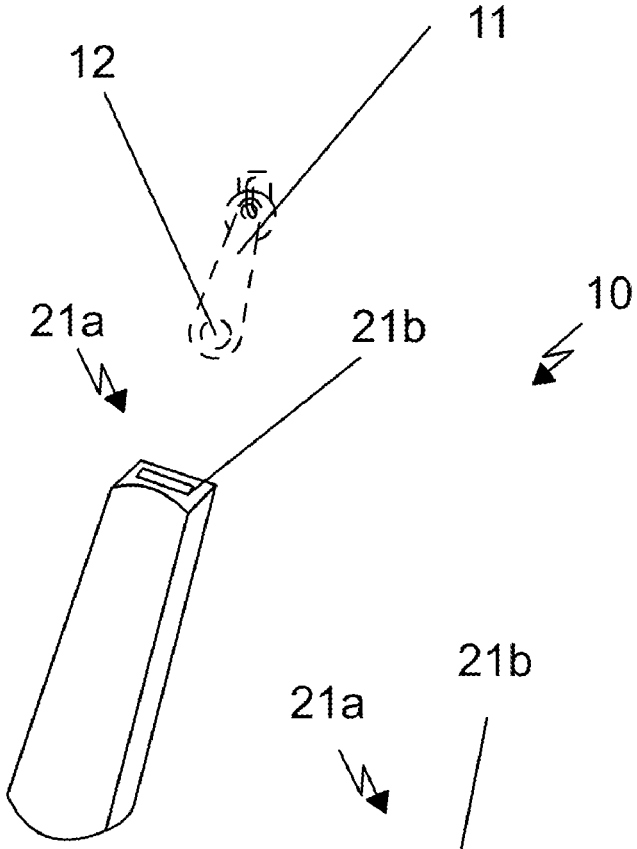
FIG. 1 is a front perspective view of a zipper pull extender, according to a preferred embodiment in accordance with the invention.

| DESCRIPTIVE KEY | |
|---|---|
| 10 | zipper pull extender |
| 11 | zipper |
| 12 | zipper aperture |
| 21a | engaging portion |
| 21b | engaging aperture |
| 22a | disengaging portion |
| 22b | tool aperture |
| 23 | interior portion |
| 24 | spring |
| 25 | hooked end |
| 30 | removal tool |
| 31 | pin |
| 32 | handle |

DETAILED DESCRIPTION OF THE PREFERRED EMBODIMENT

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 6, depicting a zipper pull extender (herein described as a "device") 10, where like reference numerals represent similar or like parts. In accordance with the invention, the present disclosure describes a device 10 that assists a user to manipulate and operate a zipper 11. The device 10 couples to an existing zipper 11 to provide a larger gripable surface area, which makes it easier for those who suffer from reduced gripping abilities to utilize the zipper 11. The device 10 is removably attachable to any zipper 11, which are commonly found on an array of clothing, handbags, outerwear, or similar items.

Figure 2:
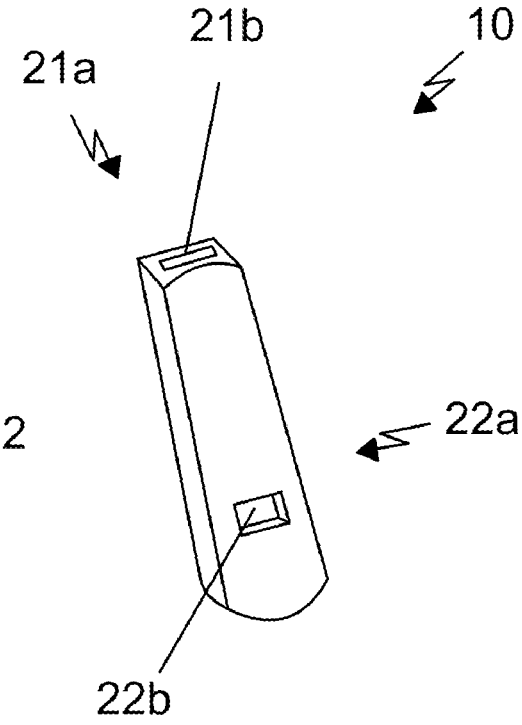
FIG. 2 is a rear perspective view of the zipper pull extender, according to the preferred embodiment.

FIG. 1 shows a front perspective view of the device 10 and FIG. 2 shows rear perspective view of the device 10. The device 10 has a generally rectangular body measuring approximately one-and-one-eighth (1⅛) inches in length and three-eighths (%) of inch in width, yet other dimensions can be utilized without limiting the scope of the device 10. The device 10 is fabricated from durable, flexible materials such as spring steel. However, it can be appreciated that various other materials comprising similar characteristics can be utilized without limiting the scope of the device 10.

The device 10 slidably engages around the zipper 11 from a proximal engaging portion 21*a*. The zipper 11 is inserted into an engaging aperture 21*b* disposed at the proximal engaging portion 21*a*. The device 10 is fabricated having an engaging aperture 21*b* with dimensions suitable for utilization with zippers 11 of various size and shape. A zipper aperture 12 of the zipper 11 is secured within the device 11 once the zipper 11 is inserted within the engaging aperture 21*b*.

A rear surface of the extender 10 includes a disengaging portion 22*a* having a tool aperture 22*b*. The tool aperture 22*b* provides interior accessing for a removal tool 30 to be inserted for removal of the zipper 11. The tool aperture 22*b* has dimensions suitable to correspond to the size of the removal tool 30 for accessing an interior portion 23 of the device 10.

Figure 3:
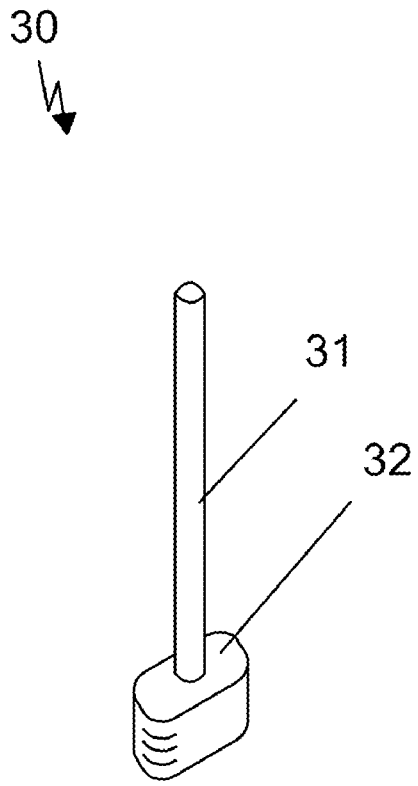
FIG. 3 is a perspective view of a removal tool, according to the preferred embodiment.

FIG. 3 shows a perspective view of the removal tool 30. The removal tool 30 is inserted through the tool aperture 22*b* to depress a spring 24 affixed to the interior portion 23 of the device 10. The removal tool 30 generally includes a pin 31 and a handle 32, yet other features can also be included. The pin 31 is a generally rod-shaped element with a diameter slightly less than the tool aperture 22*b*. The pin 31 is integrally molded to the handle 32 which provides a grip for handling of the removal tool 30. The removal tool 30 is utilized to deflect the spring 24 to disengage and remove the zipper 11 from the device 10.

Figure 4:
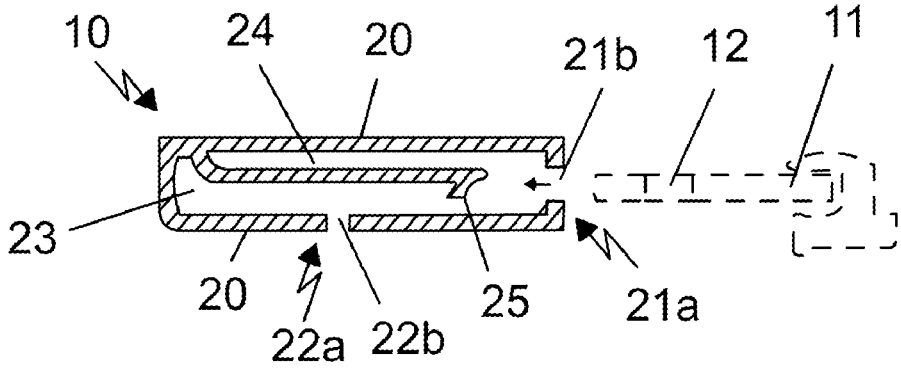
FIG. 4 is a section view of the zipper pull extender shown prior to insertion of a zipper, according to the preferred embodiment.
Figure 5:
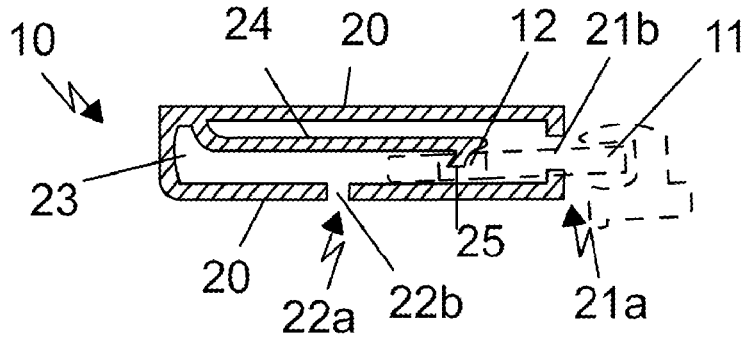
FIG. 5 is a section view of the zipper pull extender shown with of the zipper inserted, according to the preferred embodiment; and, FIG. 6 is a section view of the zipper pull extender shown with the removal tool inserted for removal of the zipper, according to the preferred embodiment.
Figure 6:
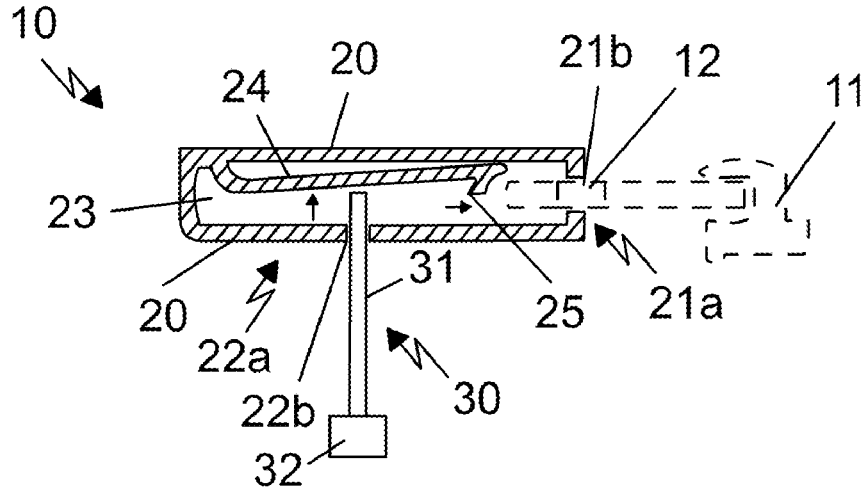

FIGS. 4, 5, and 6 show a section view of the extender 10 depicting the various stages of use and positions of the zipper 11 relative to the interior portion 23 of the device 10. The stages of use include insertion, use, and removal of a zipper 11, respectively. The spring 24 is integrally molded to an upper intermediate position opposite the engaging portion 21*a* within the internal portion 23 of the device 10. The spring 24 provides for a releasably secured attachment to the zipper 11. The spring 24 is fabricated from spring steel, yet other similar materials can be utilized. A hook end 25 projects outwardly from a free end of the spring 24 directed toward the zipper 11 to engage the zipper aperture 12. The hooked end 25 in an inwardly and downwardly shaped protrusion integrally molded to an underside of the free end of the spring 24. The spring 24 is flexible which allows for an upward deflection of the hooked end 25 to disengage from the zipper aperture 12.

In order to slidingly remove the zipper 11 from the device 10, the tool 30 is inserted into the tool aperture 22*b* and is utilized to deflect the spring 24 upwardly to disengage the hooked end 25 from the zipper aperture 12, which allows for removal of the zipper 11.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it is installed as indicated in FIGS. 1, 4 and 5 and removed as indicated in FIG. 6.

A method of installing and utilizing the device 10 can be achieved by performing the following steps: acquiring the device 10; inserting a zipper 11 into the engaging aperture 21*b* and slidably engaging the zipper 11 into the interior portion 23; enabling the hooked end 25 to engage the zipper aperture 12; grasping the device 10 to utilize the zipper 11; and, providing a means for greater independence and self sufficiency for those who suffer from reduced physical dexterity.

A method of removing the device 10 from the zipper 11 can be achieved by performing the following steps: inserting the pin 31 of the removal tool 30 into the tool aperture 22*b*; depressing the spring 24 to deflect the hooked end 25 upwardly, thereby, disengaging it from the zipper aperture 12; and, slidably removing the zipper 11 out of the device 10.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A zipper pull extender system comprising:

a generally rectangular body having a first end and an opposed second end, said body comprising a front surface and an opposed rear surface defining a hollow interior, said rear surface being parallel to said front surface;

an engaging aperture disposed at said second end of said body, said engaging aperture being defined by an opening between said front surface and said rear surface and configured to receive a pull tab of a zipper fastener within said interior;

a retaining spring having an end affixed to said front surface within said hollow interior proximate said first end of said body and a free end extending proximate said second end of said body, said retaining spring being parallel to said rear surface and configured to releasably engage said pull tab upon insertion of said pull tab into said hollow interior;

a tool aperture disposed through said rear surface of said body between said first end and said second end, said tool aperture being configured to provide access to said spring; and, a removal tool configured to be received by said tool aperture to deflect said spring and disengage said spring from said pull tab.

2. The zipper pull extender system of claim 1, wherein said spring comprises a hook proximate said free end; wherein said hook extends toward said rear surface and is configured to be received by a zipper aperture disposed through said pull tab.

3. The zipper pull extender system of claim 2, wherein said hook comprises a downwardly angled protrusion directed toward said rear surface.

4. The zipper pull extender system of claim 1, wherein said removal tool further comprises:

a generally cylindrical pin suitably sized for insertion through said tool aperture; and, a handle affixed to an end of said pin.

5. The zipper pull extender system of claim 1, wherein said hollow interior is suitably sized to receive an entirety of said pull tab of a zipper fastener.

6. A zipper pull extender system comprising:

a generally rectangular body having a first end and an opposed second end, said body comprising a front surface, a spaced apart parallel rear surface, and a pair of opposing sidewalls defining a hollow interior;

an engaging aperture disposed at said second end of said body, said engaging aperture being defined by an opening between said front surface, said rear surface, and said opposing sidewall, said engaging aperture being configured to receive a pull tab of a zipper fastener within said hollow interior;

a retaining spring having an end affixed to an interior of said front surface within said hollow interior proximate said first end of said body and an opposed free end extending proximate said second end of said body, said retaining spring being parallel to said rear surface and configured to releasably engage said pull tab upon insertion of said pull tab into said hollow interior;

a separate tool aperture disposed through a said rear surface of said body between said first end and said second end, said tool aperture being configured to provide access to said spring; and, a removal tool configured to be received by said tool aperture to deflect said spring and disengage said spring from said pull tab.

7. The zipper pull extender system of claim 6, wherein said removal tool further comprises:

a generally cylindrical pin suitably sized for insertion through said tool aperture; and, a handle affixed to an end of said pin.

8. The zipper pull extender system of claim 7, wherein free end of said spring comprises a hook; wherein said hook extends toward said rear surface and is configured to be received by a zipper aperture disposed through said pull tab.

9. The zipper pull extender system of claim 8, wherein said hook comprises a downwardly angled protrusion proximate directed toward said rear surface proximate said tool aperture.

10. The zipper pull extender system of claim 9, wherein said hollow interior is suitably sized to receive an entirety of said pull tab of a zipper fastener.

* * * * *